United States Patent [19]

Madden et al.

[11] Patent Number: 4,645,091

[45] Date of Patent: Feb. 24, 1987

[54] VALVE COVER FOR GAS STORAGE CYLINDER

[75] Inventors: Paul R. Madden, Whitehouse Station, N.J.; Andrew T. Kostanecki, Darien, Conn.; George Mileos, Riverdale, N.Y.; Michael J. Michno, Jr., Bridgewater, N.J.

[73] Assignee: Union Carbide Corporation, Danbury, Conn.

[21] Appl. No.: 798,982

[22] Filed: Nov. 18, 1985

[51] Int. Cl.[4] ..... B65D 41/06

[52] U.S. Cl. ..... 220/85 P; 220/298; 215/223

[58] Field of Search ..... 220/85 P, 293, 297, 220/298; 215/223

[56] References Cited

U.S. PATENT DOCUMENTS

| | | | |
|---|---|---|---|
| 1,254,616 | 1/1918 | Martindale | 215/223 |
| 1,948,953 | 2/1934 | Wayer et al. | 220/85 P |
| 2,080,728 | 5/1937 | MacNeil et al. | 220/85 |
| 2,216,717 | 10/1940 | Alessio | 220/85 P |
| 3,371,817 | 3/1968 | Gasbarra et al. | 220/298 |
| 3,372,836 | 3/1968 | Smith | 220/85 |
| 3,776,412 | 12/1973 | Mink | 220/85 P |
| 3,831,802 | 8/1974 | Chambers et al. | 220/85 P X |
| 4,434,903 | 3/1984 | Cooke | 215/223 X |

*Primary Examiner*—Steven M. Pollard

*Attorney, Agent, or Firm*—Stanley Ktorides

[57] ABSTRACT

A valve cover for a gas storage cylinder comprising a support member affixed to the cylinder and a cap member matingly engageable to the support member by means of a double-acting lock.

19 Claims, 6 Drawing Figures

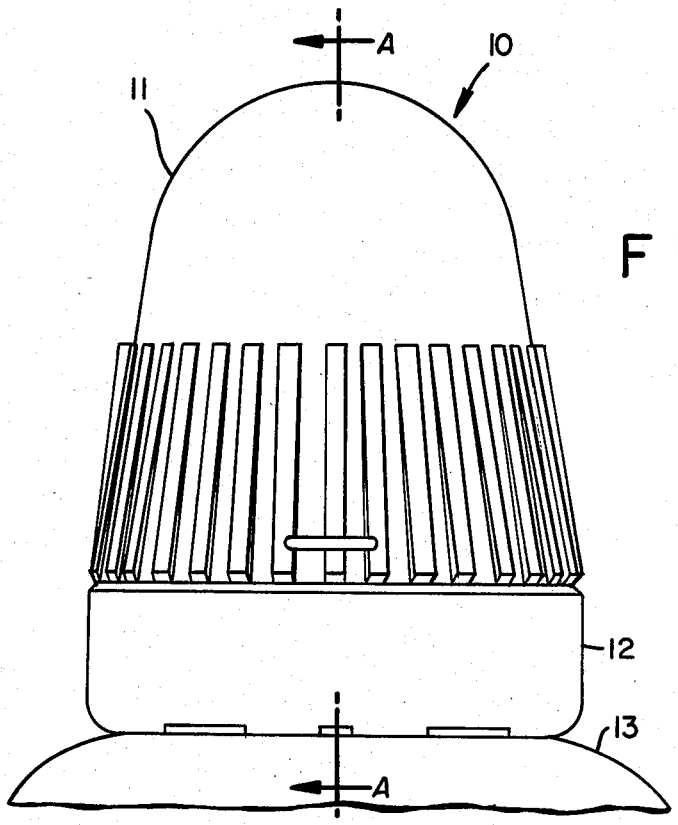
FIG. 1
FIG. 4
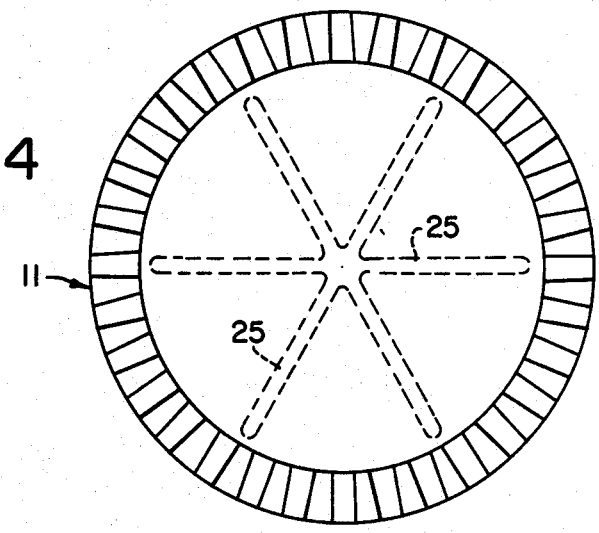

VALVE COVER FOR GAS STORAGE CYLINDER

TECHNICAL FIELD

This invention relates to gas storage cylinders and, in particular, to protective covers for valves at the top of such cylinders.

BACKGROUND OF THE INVENTION

High pressure gas storage cylinders are typically low diameter and tall cylindrical vessels. The cylinders normally stand on the bottom of the vessel in an upright position. The gas storage cylinder is charged or discharged through the top opening by means of a suitable gas valve assembly. Usually, the gas valve assembly will include a regulator so as to withdraw the gas at a desired pressure level since often the cylinder storage pressure level is too high for use purposes. Since the gas storage cylinder is a relatively tall vessel with a small base, it can be subject to tipping. Should such a vessel fall, it is possible that the top valve assembly could be subjected to mechanical damage and cause dangerous discharge of the gas contents. Since the gas is stored in the cylinder at high pressure, any inadvertent gas discharge could result in high exiting gas velocity which would tend to propel the vessel and possibly damage surrounding equipment or personnel. Accordingly, it is important that the top valve assembly be protected from damage when the cylinder is not in use. In addition, U.S. Department of Transportation regulations require valves to be protected when gas storage cylinders are used in the transportation of certain gases. Further, since the valve assembly must be operated to regulate gas charging and discharging, it is imperative that the valve be protected from weather to prevent undesirable corrosion and deterioration of the valve assembly. It is conventional practice to protect the valve assembly of a high pressure gas cylinder with a suitable protective valve cover that serves to prevent physical damage or exposure of the valve to the weather.

Generally, the valve cover is attached to the gas storage cylinder by screwing onto a threaded piece which is attached to the cylinder. However, such an arrangement has several drawbacks. First, it requires a number of turns of the valve cover to securely attach the valve cover to the threaded piece. This is clumsy and time consuming. Second, such an arrangement is subject to loosening, leading to a potentially dangerous situation. This is because gas storage cylinders are often moved by turning the cylinder while pushing or pulling it along a surface. Third, the threads can corrode or otherwise foul making it difficult to remove the valve cover.

Accordingly, it is an object of this invention to provide an improved valve cover for a gas storage cylinder.

It is another object of this invention to provide an improved valve cover for a gas storage cylinder which can be easily and quickly attached and removed from the gas storage cylinder.

It is an further object of this invention to provide an improved valve cover for a gas storage cylinder which cannot easily be inadvertently loosed during rolling of the cylinder along its base.

SUMMARY OF THE INVENTION

The above and other objects which will become apparent to one skilled in the art upon a reading of this disclosure are attained by this invention which comprises:

A valve cover for a gas storage cylinder comprising a support member for affixation to the cylinder and a cap member capable of matingly engaging the support member, said support member being ring- shaped and having at least one locking aperture along its circumference, said locking aperture comprising: an indentation along the inner circumference having a first depth communicating with a first channel circumferentially adjacent the indentation, said first channel having a second depth communicating with a second channel circumferentially adjacent said first channel and having a taper declining away from the first channel said cap member having at one end a ring shape corresponding so that of the support member, said ring-shaped end having at least one tab of a size capable of insertion into said locking aperture, said tab having a taper on a bearing edge of the tab corresponding to the taper of the second channel.

As used herein, the terms "top, bottom, upper or lower" and terms of like meaning, describe subjects when the gas storage cylinder is oriented upright.

As used herein, the term "valve cover" means a covering which fits on the neck of a gas storage cylinder, which generally, but not necessarily, covers a valve.

As used herein, the term "gas storage cylinder" means any vessel for the storage of gas at pressure and is not intened to be limited to vessels having a cylindrical shape.

As used herein, the term "bearing edge" means the edge of the tab which bears against a channel upper surface when the cap member is attached to the support member.

BRIEF DESCRIPTION OF THE DRAWINGS

FIG. 1 is a representation of a preferred embodiment of the valve cover assembly of this invention fully in place on a gas storage cylinder.

FIG. 4 is a plan view of the cap member of FIG. 3.

DETAILED DESCRIPTION

The valve cover of this invention will be described in detail with reference to the drawings.

Referring now to FIG. 1, valve cover assembly 10 is mounted on gas storage cylinder 13 and comprises a cap member 11 and support member 12. The support member 12 is ring-shaped and fits on and around the top portion of cylinder 13. Cap member 12 is correspondingly ring-shaped at one end so as to be capable of matingly engaging the support member.

Figure 2:
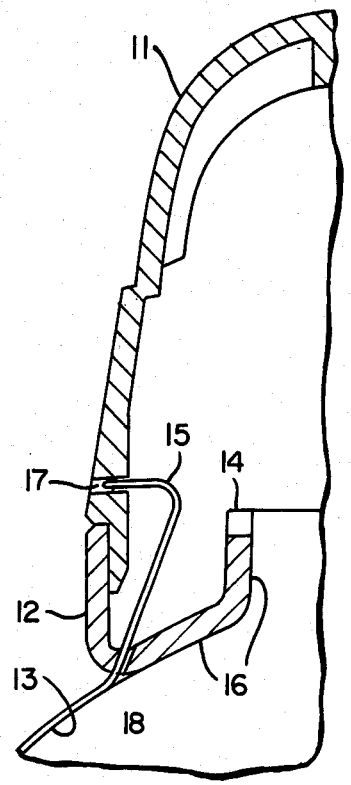
FIG. 2 is a cross-sectional view of the valve cover of FIG. 1 taken along line A—A.

FIG. 2 is a cross-sectional view of FIG. 1 taken along line A—A. Cap member 11 and support member 12 are preferably connected and FIG. 2 illustrates a preferred method of connection. The two valve cover members are preferably connected so as to avoid the loss or misplacement of cap member 11 when it is removed from the support member. Preferably the two valve cover members are connected by means of cord 15 which is attached to the internal surfaces of cap member 11 and support member 12 by means of slots 17 and 18, respectively. The use of such internal cord 15 helps to prevent the cord from inadvertently becoming snagged or caught on surrounding equipment or by personnel passing the vessel and thereby possibly the inadvertent tipping of the gas storage cylinder. The cord may be made of any suitable material and can be attached to the respective internal surfaces by suitable means other than the illustrated slots. Such suitable means include rivets or other suitable fasteners.

The cross sectional view of FIG. 2 shows a preferred means of attachment of the support member to the gas storage cylinder. The support member preferably is formed so that it has a center opening which allows the support member to fit over the neck of gas storage cylinder 13. Additionally, the bottom portion of support member 12 is formed so that it follows the contour of the cylinder top and thereby rests firmly against the cylinder. The attachment is preferably by use of a top washer 14 which serves to retain the support member 12 on the cylinder 13. That top washer 14 is preferably a metal washer which can be attached to the cylinder by several methods. For example, the top washer can be fixed in position by ball peening the edge of the cylinder or the washer can be of the slot locked or snap ring type. A secondary means of attaching the support member to the cylinder can be to apply suitable adhesive between the support member and the cylinder along the surface that rests against the cylinder as at location 16. The adhesive serves to hold the support member in position and prevents it from rotating relative to the cylinder vessel. The combination of the metal washer and adhesive serves to securely anchor the support member to the cylinder vessel and is the most preferred means of affixing the support member to the gas storage cylinder.

Support member 12 preferably also has one or more perforations therethrough to allow pressure relief of gas which might otherwise build up within the valve cover and/or to allow drainage of liquid, such as condensed water, which might otherwise collect within the valve cover. Such perforations are preferably at the lowermost portion of the support member. A preferred arrangement is to employ the locking aperture or apertures, which will be described later in more detail, as the perforation means for pressure relief and/or drainage.

Figure 3:
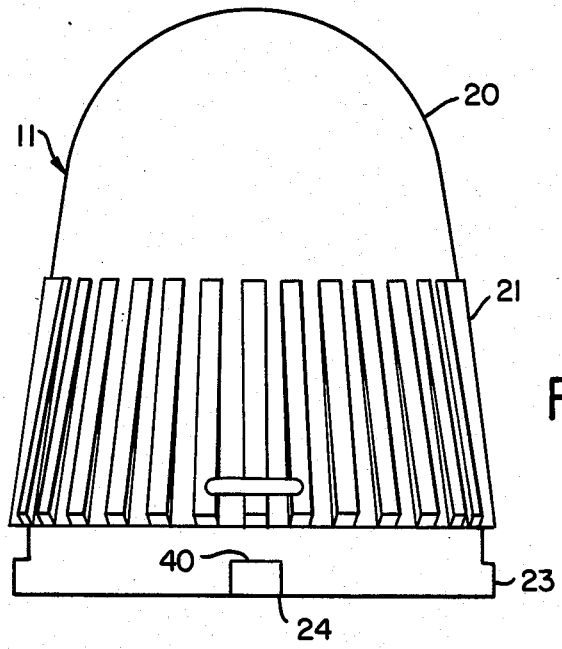
FIG. 3 is a representation of a preferred embodiment of the cap member of the valve cover of this invention.

FIGS. 3 and 4 illustrate the cap member in more detail. Referring now to FIG. 3, cap member 11 is comprised of a relatively smooth top section 20 and a roughened bottom section 21. The roughened bottom section is preferably ribbed as shown in FIG. 3. The cap member is preferably of a truncated ellipsoid shape which engages the support member to form an enclosure to enclose the top portion of a gas storage cylinder housing a valve assembly. The truncated ellipsoid shape provides a convenient shape for handling when rolling the gas storage cylinder along its bottom and also provides an aesthetically pleasing shape to complement the general shape of the cylinder. The smooth surface 20 at the upper portion of cap member 11 serves to give a convenient hand-hold for handling the cylinder whereas the roughened portion 21 provides increased friction to facilitate removal of the cap member 11 from the support member 12. In addition, when the roughened section comprises a series of external ribs, this serves to lend structural support to the valve cover. This added structural support is particularly advantageous when the cylinder falls from a vertical orientation and forcefully impacts something with the valve cover.

The cap member 11 is ring-shaped at the bottom to correspond to the shape of the support member. This ring-shaped bottom has at least one tab, and preferably has four tabs, attached to it which are of a size capable for insertion into corresponding locking apertures on the support member. In FIG. 3, such tabs are represented by 23 and 24. FIG. 3 illustrates a preferred embodiment having 4 equidistantly spaced tabs; one such tab is not shown. As best shown by tab 24, the tabs are tapered such that the end leading into the locking aperture channels is thinner than the opposite end of the tab. This results in the top on bearing edge 40 of the tab having a taper which corresponds to the taper of the second channel of the locking aperture as will be more fully explained later. This taper increases the locking capability of the two-pice valve cover and helps to attain a secure mating between the cap member and the support member.

FIG. 4 is a top view of FIG. 3 and shows more clearly the ring shape at the bottom of the cap member. FIG. 4 also illustrates a number of internal ribs 25 attached to the inside of the cap member 11 which lend structural support to the cap member. Such internal ribs are preferably equispaced on the inside of cap member 11.

Figure 5:
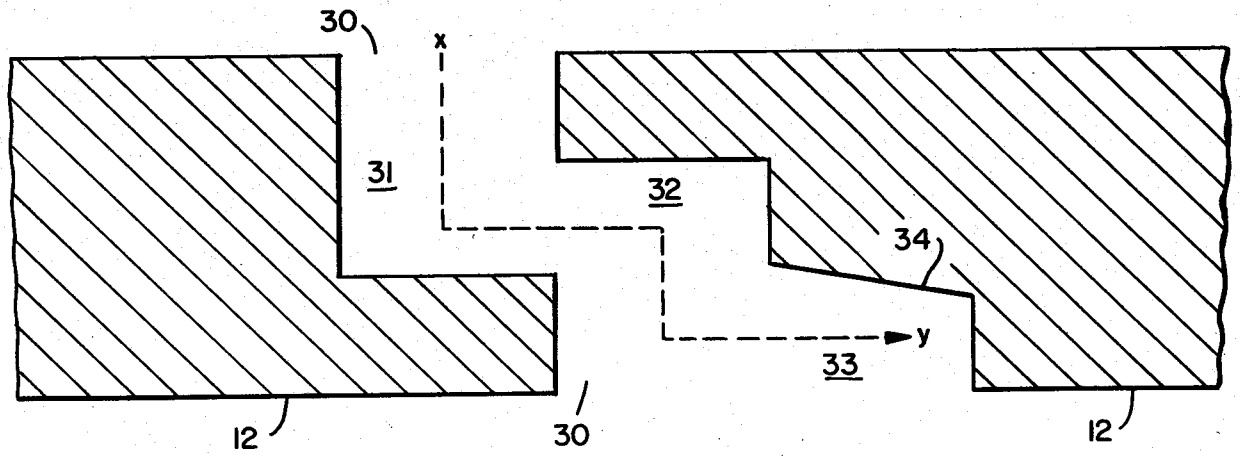
FIG. 5 is a representation of one embodiment of the locking aperture of the support member of the valve cover of this invention.

FIG. 5 illustrates the locking aperture 30 of this invention. The locking aperture is a slot on the inner circumference of support member 12 at the point where it matingly engages cap member 11. Support member 11 has at least one such locking aperture and has at least as many locking apertures as there are tabs on the cap member. The tabs and locking apertures are spaced around the cap member and support member, respectively, so as to correspond to one another, i.e., so that each tab engages a locking aperture.

Locking aperture 30 comprises an indentation 31 in the support member having a first depth, i.e., vertical distance as seen in FIG. 5, which does not go completely through the support member but which communicates with first channel 32 which is circumferentially adjacent the indentation 31. First channel 32, in turn has a second depth which communicates with second channel 33 which is circumferentially adjacent to first channel 32. Second channel 33 has a tapered edge 34 which corresponds to the taper on the tab inserted into the locking aperture and which declines away from the first channel. The tapered edge 34 causes the tapered tab to bear against the second channel upper surface and thus ensure that the cap member is held to the support member.

Path X-Y in FIG. 5 describes the path the tab takes as it traverses locking aperture 30 into the fully locked position in second channel 33. When one wishes to secure the cap member to the support member, one (1) aligns the tab or tabs on the cap member with the corresponding indentations on the support member, (2) pushes the cap member down so that the tabs pass through indentations 31, (3) partly rotates the cap member so that the tabs pass into first channels 32, (4) pushes the cap member downward again, and (5) partly rotates the cap member a second time so that the tabs pass into second channels 33, thus achieving the fully locked position. To remove the cap member from the support member the above-described procedure is reversed.

In a preferred embodiment the second channel or channels 33 also serve as the aforedescribed pressure relief and drainage perforations.

The valve cover arrangement of this invention alleviations some important inadequacies of gas storage cylinder valve covers. First, the valve cover is easily attached and removed. Attachment or removal requires a few short movements and only partial rotation of the cap member. In contrast conventional employed screw-on covers require a number of full 360 degree turns of a cover piece to completely secure or remove the cover. Second the valve cover of this invention is not nearly as likely as the conventional screw-on covers to come loose during rolling of the cylinder along its base by rotating the cover. Furthermore, even if the valve cover of this invention is loosened during such rotation, the handler can easily sense the looseners since the cap member will rattle as the tabs pass in and out of second channels 33, and can take steps to resecure the valve cover. Such rotational action, however, will not cause the tabs to pass into first channel 32 and out of the locking aperture and thus there is little danger of the cap member coming completely off the support member. Third, the valve cover of this invention is not nearly as likely as conventional valve covers to seize in place due to thread corrosion or other types of thread fouling.

The valve cover of this invention may be constructed of any suitable material. It is preferred that the valve cover be constructed of plastic, most preferably polyarylate, such as Ardel DIOO TM or Ardel D170 TM polyarylate plastic, or other plastics such as Lexan TM or Zytel TM . Preferably, the valve cover is constructed of a transparent or translucent plastic as this allows visual inspection of the valve assembly without removal of the cap member. The valve cover may also be constructed of metal such as carbon steel, stainless steel or aluminum. Aluminum is the preferred material when the valve cover is constructed of metal because of the lighter weight of aluminum compared to other metals.

Figure 6:
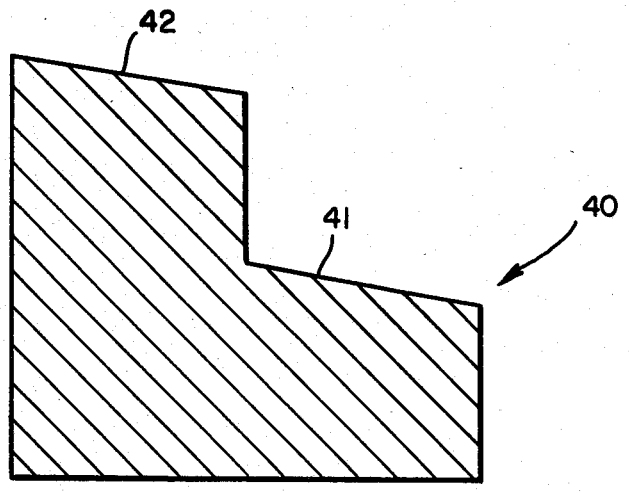
FIG. 6 is a representation of a tab useful in this invention which has more than one bearing edge.

The valve cover of this invention has been described in detail with reference to certain preferred embodiments. It can be appreciated, however, by those skilled in the art that there are other embodiments of this invention which fall within the spirit and scope of the claims. For example, the lock may be triple etc.—acting by having a locking aperture with three or more depths and adjacent channels. In such a case, the "second" channel of the invention would correspond to the lowermost channel. In another embodiment, which may be useful to effect a more secure lock, the tab may have more than one bearing edge, such as the tab 40 illustrated in FIG. 6 which has two bearing edges numbered 41 and 42. In a tab embodiment such as is shown in FIG. 6, only one of the bearing edges need be tapered although it is preferred that they all be tapered. The relevent channel upper surfaces corresponding to each bearing edge would be tapered or non-tapered accordingly.

We claim:

1. A valve cover for a gas storage cylinder comprising a support member for affixation to the cylinder and a cap member capable of matingly engaging the support member, said support member being ring-shaped and having at least one locking aperture along its circumference, said locking aperture comprising: an indentation along the inner circumference having a first depth communicating with a first channel perpendicular to the first depth and circumferentially adjacent the indentation, said first channel having a second depth communicating with a second channel perpendicular to the second depth and circumferentially adjacent said first channel and having a taper declining away from the first channel; said cap member having at one end a ring shape corresponding to that of the support member, said ring-shaped end having at least one tab of a size capable of insertion into said locking aperture, said tab having a taper on a bearing edge of the tab corresponding to the taper of the second channel.

2. The valve cover of claim 1 wherein the support and cap members are connected by a cord attached to each member at its respective inside surface.

3. The valve cover of claim 1 wherein the cap member comprises a smooth outer surface distant from the ring-shaped end and a roughened outer surface proximate the ring-shaped end.

4. The valve cover of claim 3 wherein the roughened outer surface comprises a series of external ribs.

5. The valve cover of claim 1 wherein the support member has at least one perforation therethrough for pressure relief or liquid drainage of material from within the valve cover.

6. The valve cover of claim 5 wherein said perforation comprises at least part of the second channel.

7. The valve cover of claim 1 wherein the cap member is in the form of a truncated ellipsoid.

8. The valve cover of claim 1 wherein the cap member has at least one supporting rib on its inside surface.

9. The valve cover of claim 1 constructed of plastic.

10. The valve cover of claim 9 wherein said plastic is a polyarylate.

11. The valve cover of claim 9 wherein said plastic is translucent.

12. The valve cover of claim 9 wherein said plastic is transparent.

13. The valve cover of claim 1 constructed of metal.

14. The valve cover of claim 1 wherein the support member is adhesively affixed to the cylinder.

15. The valve cover of claim 1 wherein the support member is affixed to the cylinder by a metal washer which is slot locked into position.

16. The valve cover of claim 1 wherein the support member is affixed to the cylinder by a metal washer which is peened into position.

17. The valve cover of claim 1 wherein the cap member has 4 equispaced tabs and the support member has 4 correspondingly equispaced locking apertures.

18. The valve cover of claim 1 wherein said tab has more than one bearing edge.

19. The valve cover of claim 18 wherein each bearing edge of said tab is tapered.

* * * * *